US008262243B1

(12) United States Patent
Pasdar

(10) Patent No.: US 8,262,243 B1
(45) Date of Patent: Sep. 11, 2012

(54) CHRISTMAS ORNAMENT WITH SELECTABLE ILLUMINATION AND MOTION MECHANISMS

(76) Inventor: Mohammad B. Pasdar, Halifax (CA)

( * ) Notice: Subject to any disclaimer, the term of this patent is extended or adjusted under 35 U.S.C. 154(b) by 0 days.

(21) Appl. No.: 13/469,424

(22) Filed: May 11, 2012

(51) Int. Cl.
*F21S 6/00* (2006.01)
*F21S 4/00* (2006.01)

(52) U.S. Cl. ..... 362/124; 362/249.03; 362/249.06; 362/249.14; 362/249.09

(58) Field of Classification Search ..... 362/124, 362/123, 230, 231, 249.02–249.09, 249.14–249.19, 362/234, 253, 285, 286, 418, 419, 800, 806, 362/808; 446/485; 211/1.51; 40/414
See application file for complete search history.

(56) References Cited

U.S. PATENT DOCUMENTS 4,215,277 A 7/1980 Weiner et al.
4,455,562 A 6/1984 Dolan et al.
5,300,864 A 4/1994 Allen, Jr.
5,629,587 A 5/1997 Gray et al.
5,766,601 A * 6/1998 Ennis ..... 424/206.1
5,784,815 A * 7/1998 Hermanson ..... 40/414
5,850,927 A * 12/1998 Pan ..... 211/181.1
6,285,140 B1 9/2001 Ruxton
6,384,545 B1 5/2002 Lau
6,394,282 B1 * 5/2002 Pan ..... 211/1.51
6,478,164 B1 * 11/2002 Pan ..... 211/1.51
6,758,001 B1 * 7/2004 Su ..... 40/538
7,015,825 B2 * 3/2006 Callahan ..... 340/815.45
7,131,748 B2 * 11/2006 Kazar et al. ..... 362/231
7,186,003 B2 3/2007 Dowling et al.
7,327,337 B2 2/2008 Callahan
2005/0180163 A1 8/2005 Huang
2007/0097685 A1 * 5/2007 Gan ..... 362/252
2009/0218952 A1 9/2009 Tang
2011/0085327 A1 * 4/2011 Chen ..... 362/235
2011/0151147 A1 * 6/2011 Kinderman ..... 428/16

* cited by examiner

*Primary Examiner* — Bao Q Truong
(74) *Attorney, Agent, or Firm* — Montgomery Patent & Design, LLC; Robert C. Montgomery; Joseph Yaksich

(57) ABSTRACT

A Christmas ornament with selectable illuminating means comprises movable parts and an illumination system which changes color. The apparatus is illuminated with an RGB LED light string which changes color automatically. The color change operation is governed by a self-mounted PIC microcontroller with a customized programming, which directs the microcontroller to change the color of the RGB light string across a broad range of discrete colors. The color change can be controlled as a gradual transition and could be manually controlled to allow lights to remain a particular color as desired. The apparatus is powered by AC power and has a weatherproof construction to allow for outdoor use.

13 Claims, 7 Drawing Sheets

CHRISTMAS ORNAMENT WITH SELECTABLE ILLUMINATION AND MOTION MECHANISMS

RELATED APPLICATIONS

There are currently no applications co-pending with the present application.

FIELD OF THE INVENTION

The present invention relates generally to illuminated ornaments, and in particular, to ornaments which comprise selectable illumination.

BACKGROUND OF THE INVENTION

The holiday season is a time of great fun and happiness for almost everyone. A great deal of the holiday cheer comes from the yearly traditions that are passed from generation to generation. One (1) of these traditions that many people enjoy and take great pride in is the decorating of one's home with festive lights. Whether the lights are on a tree, along a roof line, or down railings, lights are what truly adds the magic to the holidays. There has been an increase in recent years of different types of lights available to the consumer such as sequenced lights, icicle lights, cascading lights and the like. As such, their widespread use has diminished their uniqueness, leaving many people looking for the next outdoor lighting craze. Common yard decorations are created as a fixed object or with limited actions and movements. Common yard decorations also comprise a single color unchanging light source. Accordingly, there is a need for a means by which exterior holiday lighting, particularly that on movable self standing outdoor decorations, can be enhanced to address these concerns.

Various attempts have been made to provide a Christmas ornament with selectable illumination means. Examples of these attempts can be seen by reference to several U.S. Patent No. 2005/0180163, issued in the name of Huang, describes a fiber optic Christmas tree with multiple light sources and sections.

U.S. Pat. No. 7,015,825, issued in the name of Callahan, describes a decorative lighting system.

U.S. Pat. No. 7,186,003, issued in the name of Dowling et al., describes a high-brightness LED's and processor control.

While these devices fulfill their respective, particular objectives, each of these references suffer from one (1) or more disadvantages. Many such devices are not suited for a selectable and movable ornament. Accordingly, there exists a need for Christmas ornament with selectable illumination means without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a Christmas ornament with selectable illumination means.

Accordingly, it is an object of the present embodiments of the invention to solve at least one of these problems. The inventor has addressed this need by developing Christmas ornament with selectable illumination means provides a movable ornament with various selectable illumination patterns.

To achieve the above objectives, it is an object of the present invention to provide a Christmas ornament with selectable illumination means comprising a decorative holiday structure.

Another object of the present invention is to provide the decorative holiday structure with a plurality of light-emitting diodes upon a plurality of light string cables.

Yet still another object of the present invention is to provide a controller enclosure to connect the light string cables.

Yet still another object of the present invention is to provide a power cord to provide power.

Yet still another object of the present invention is to provide servo motors to provide for realistic and random motion of the decorative holiday structure.

Yet still another object of the present invention is to control the system with a PIC microcontroller.

Yet still another object of the present invention is to enable the PIC microcontroller to change the color of the light-emitting diodes to various discrete different colors.

Yet still another object of the present invention is to provide a method of utilizing the device that provides a unique means of attaching the light-emitting diodes and servo motors to the structure, interconnecting the controller enclosure, loading the PIC microcontroller with an operating program, setting the Christmas ornament with selectable illumination means in a desired displaying location, activating the system as desired, and utilizing the Christmas ornament with selectable illumination means to provide for a colored holiday decoration that change color in a unique and eye-catching manner.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

Figure 4A:
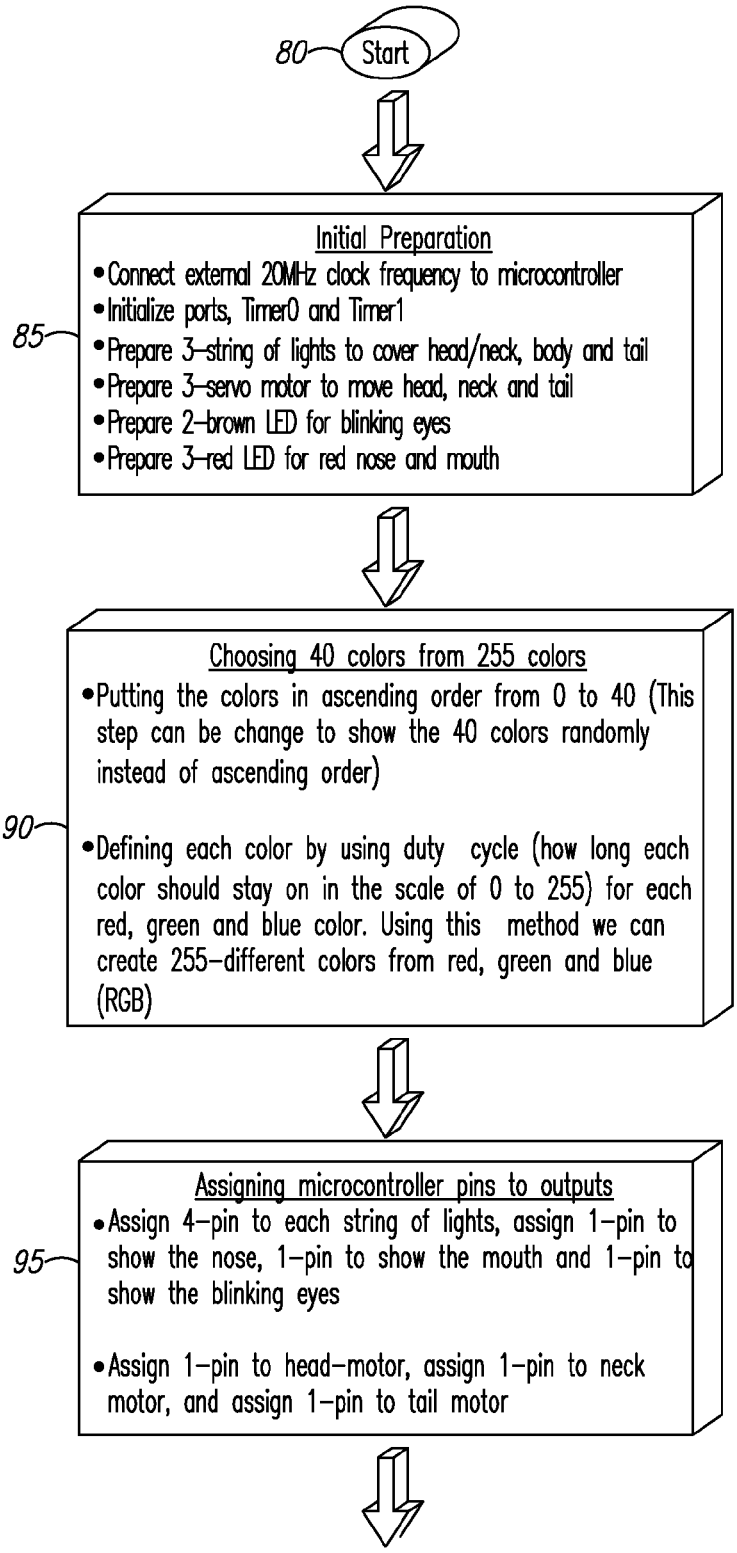
Figure 4B:
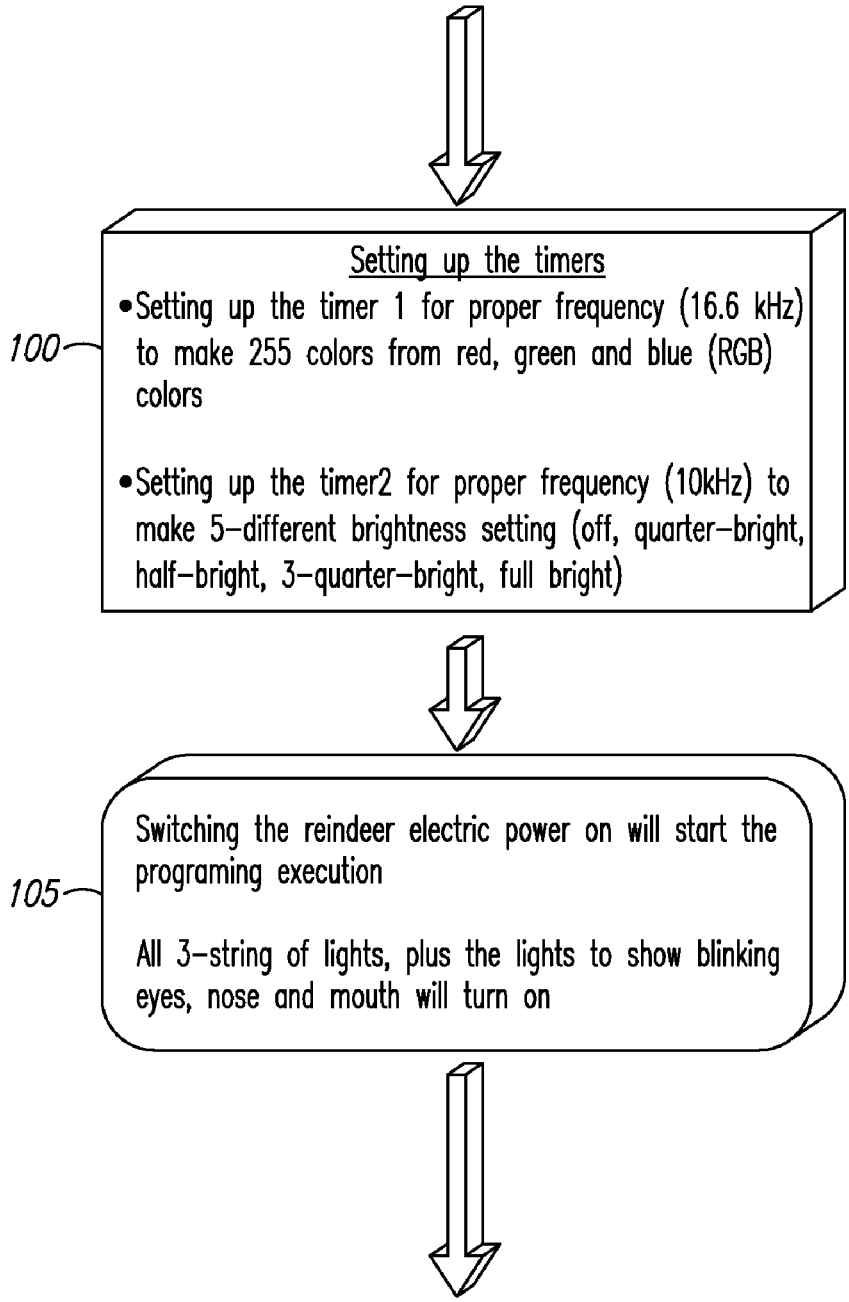
Figure 4C:
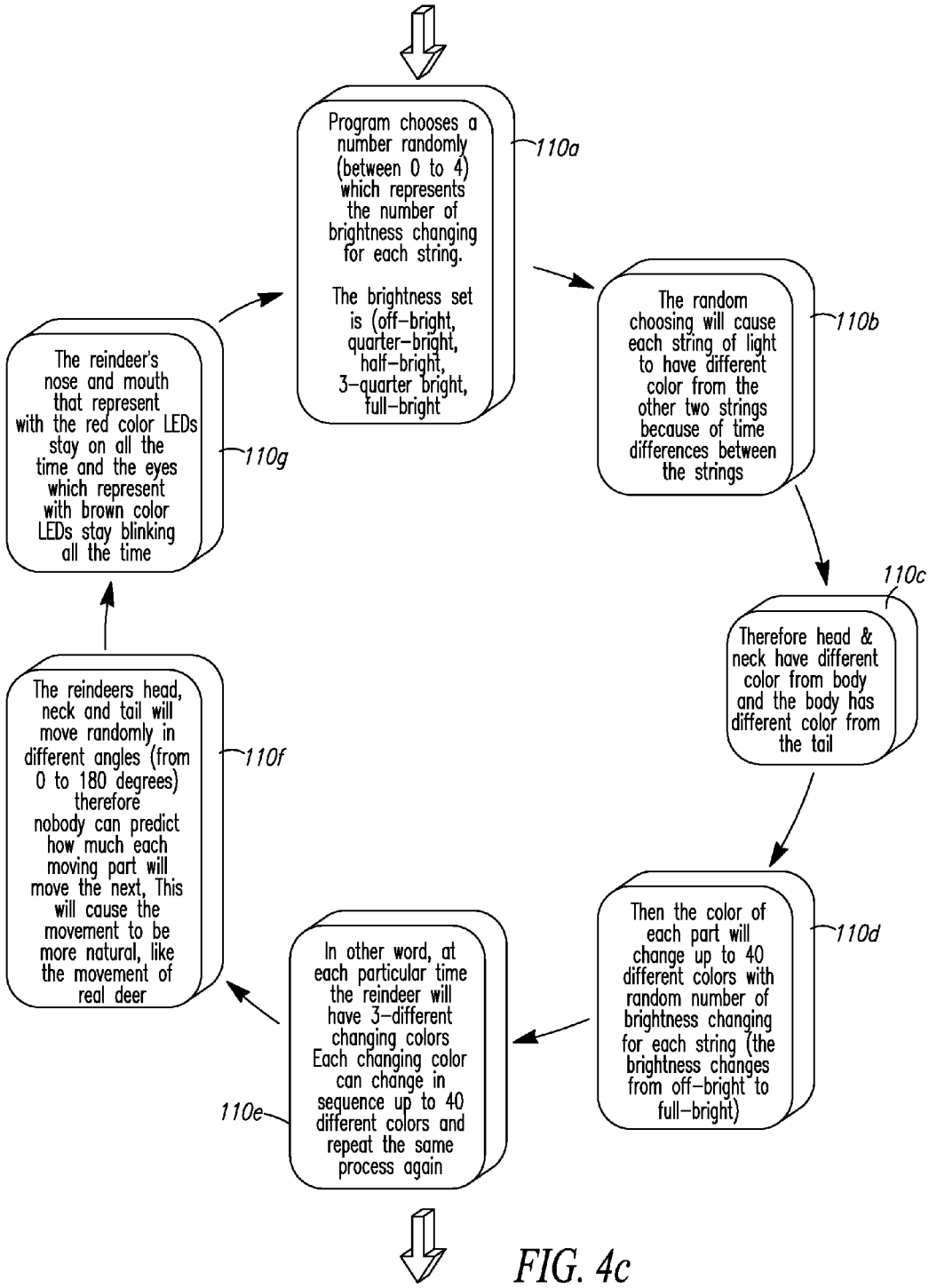
Figure 4D:
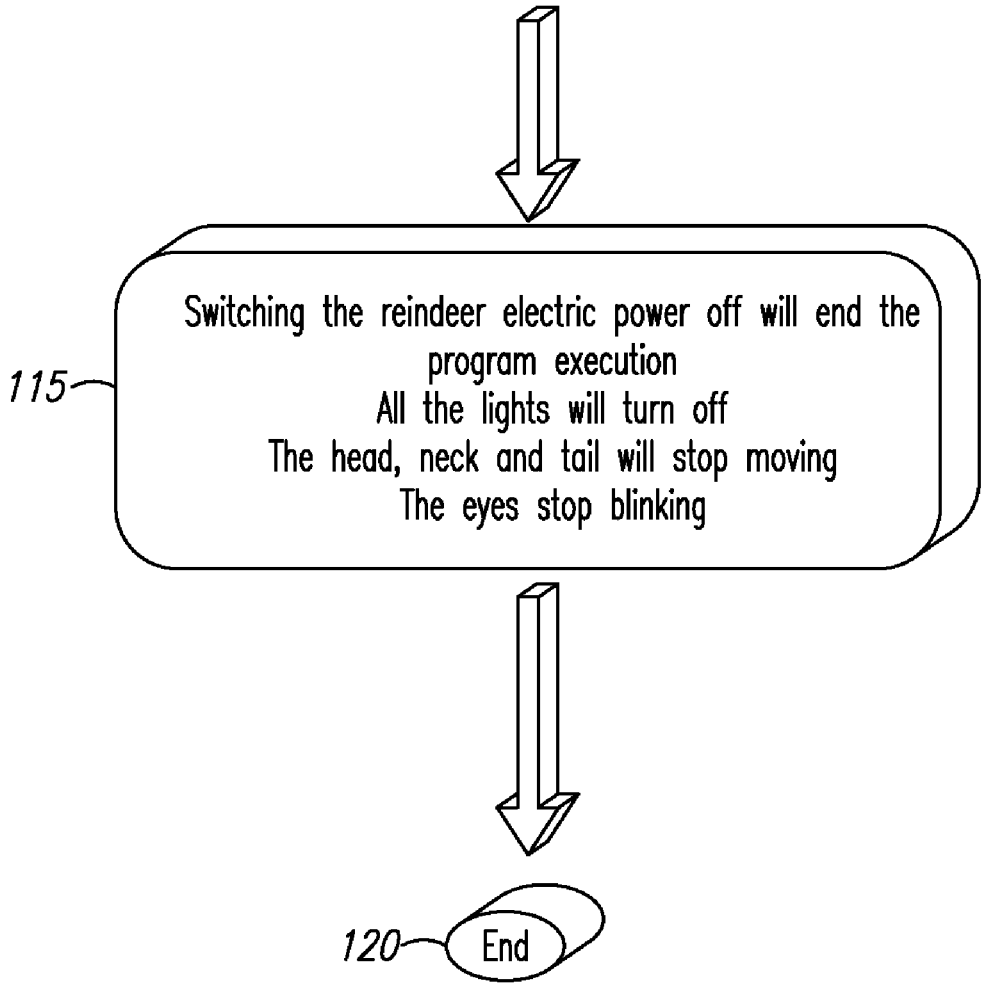

FIG. **4*a* is page 1 of a functional flow diagram depicting operation of the user selectable lighting/decoration system 10** according to the preferred embodiment of the present invention;

FIG. **4*b* is page 2 of a functional flow diagram depicting operation of the user selectable lighting/decoration system 10** according to the preferred embodiment of the present invention;

FIG. **4*c* is page 3 of a functional flow diagram depicting operation of the user selectable lighting/decoration system 10 according to the preferred embodiment of the present invention; and, FIG. 4*d* is page 4 of a functional flow diagram depicting operation of the user selectable lighting/decoration system 10** according to the preferred embodiment of the present invention.

DESCRIPTIVE KEY

10 user selectable lighting/decoration system
15 decorative holiday structure
20 RGB light-emitting diodes (LED)
25 light string cables
30 controller enclosure
35 power cord
40 servo motors
45 servo control cables
50 opaque plastic cover
55 PIC microcontroller
60 quartz oscillator
65 transistors
70 dropping resistors
75 transformer
80 begin process block
85 first functional block
90 second functional block
95 third functional block
100 fourth functional block
105 fifth functional block
110*a* first loop block
110*b* second loop block
110*c* third loop block
110*d* fourth loop block
110*e* fifth loop block
110*f* sixth loop block
110*g* seventh loop block
115 sixth functional block
120 end process block

DETAILED DESCRIPTION OF THE PREFERRED EMBODIMENT

The best mode for carrying out the invention is presented in terms of its preferred embodiment, herein depicted within FIGS. 1 through 4*d*, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
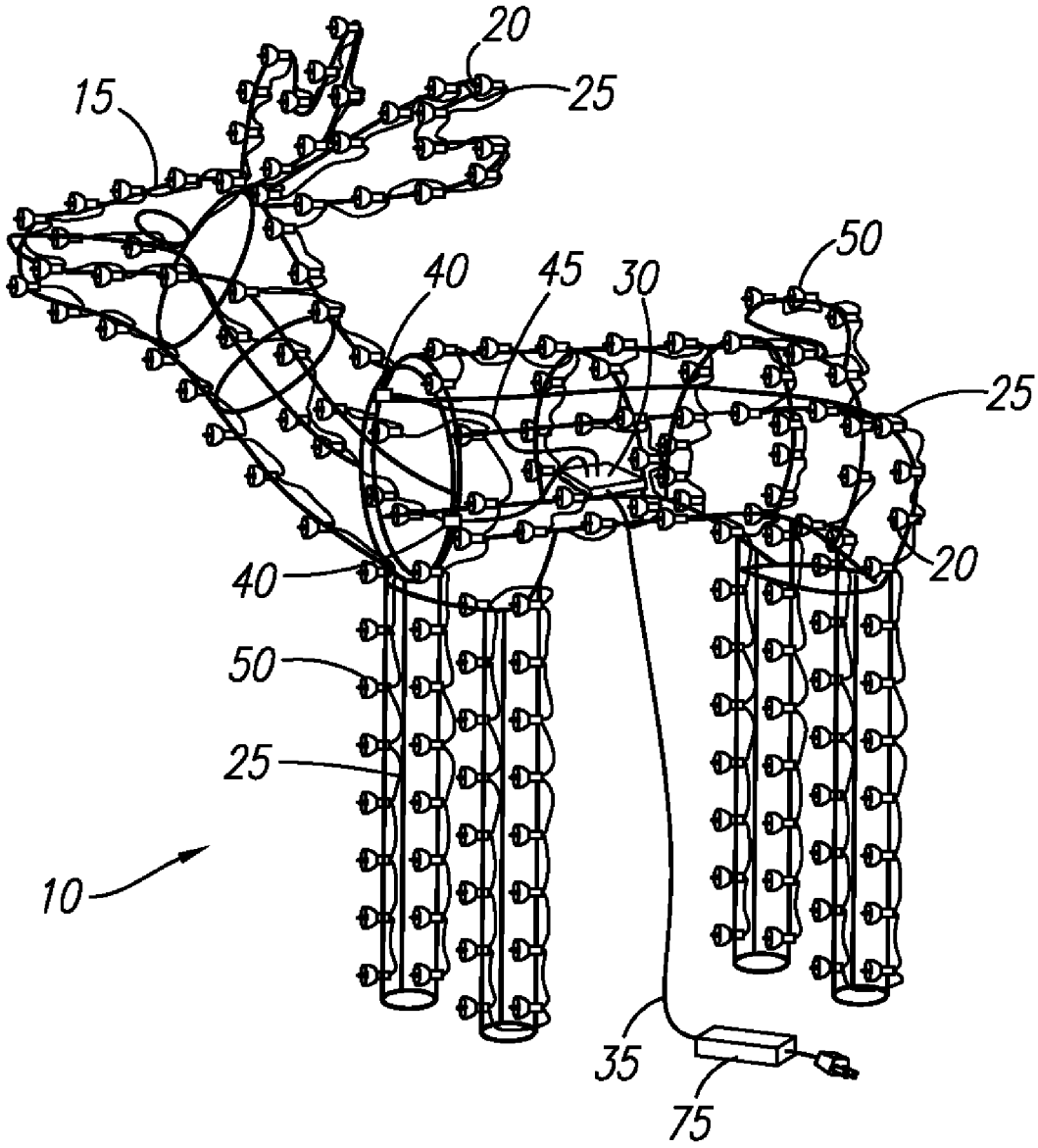
FIG. 1 is an isometric of the user selectable lighting/decoration system 10, according to the preferred embodiment of the present invention.

Referring now to FIG. 1, an isometric view of the user selectable lighting/decoration system 10 (herein known as the "system"), according to the preferred embodiment of the present invention, is disclosed. The system 10 is placed upon a decorative holiday structure 15 to provide the functionality of form and structure. For purposes of illustration, the decorative holiday structure 15 is depicted as a reindeer. However, other structures of varying size and shape, such as Christmas trees, snowmen, Santa Claus, and the like, can be used with equal effectiveness and as such, should not be interpreted as a limiting factor of the present invention. Such structures are well-known in the art and not elaborated upon in this description due to the wide variety of structures envisioned to be suitable for use with the present invention.

The invention utilizes a plurality of RGB light emitting diodes (LED) 20 located on one (1) or more light string cables 25. A total of three (3) light string cables 25 are utilized for purposes of illustration for the remainder of this object. It is envisioned that approximately thirty (30) RGB light emitting diodes (LED) 20 can be placed on each light string cables 25 with a three inch (3 in.) spacing between each RGB light-emitting diodes (LED) 20 RGB LED's thus providing for a total length of approximately ninety inches (90 in.). Should three (3) independent light string cables 25 be utilized, this allows for approximately two hundred seventy inches (270 in.) of decorative lights without exceeding the thermal capacity of the electronic components in the controller enclosure 30 (as will be described in greater detail herein below. The light string cables 25 connect into a controller enclosure 30 located somewhere on the decorative holiday structure 15 in a hidden location.

A power cord 35 comprising an in-line 110vAC to 5vDC transformer 75 provides power to the user selectable lighting/decoration system 10 in a conventional manner. A series of servo motors 40 are also located upon the decorative holiday structure 15 to provide for realistic and random motion of the decorative holiday structure 15. Examples of said motion include hand, arm, head, neck, tail, and leg motion of the various figurines depicted by the decorative holiday structure 15. The servo motors 40 are also connected back the controller enclosure 30 by an independent servo control cables 45 for each servo motors 40. An opaque plastic cover 50 is provided over each RGB light-emitting diodes (LED) 20. The opaque plastic cover 50 is approximately two inches (2 in.) in diameter and provides for the effect of a conventional incandescent lamp by allowing for the diffusion of the light rays from the RGB light-emitting diodes (LED) 20 and provides additional environmental protection for the RGB light-emitting diodes (LED) 20 should the user selectable lighting/decoration system 10 be utilized outside. Said features allow for control of the RGB light-emitting diodes (LED) 20 with regards to color displayed, rate or level of illumination that varies with time, and finally also allows for movement of the decorative holiday structure 15 to provide a highly-effective and eye-catching decorative item.

It is understood that other structures of varying size and shape, such as Christmas trees, snowmen, Santa Claus, and the like, can be used with equal effectiveness and as such, should not be interpreted as a limiting factor of the present invention. Such structures are well-known in the art and not elaborated upon in this description due to the wide variety of structures envisioned to be suitable for use with the present invention.

Figure 2:
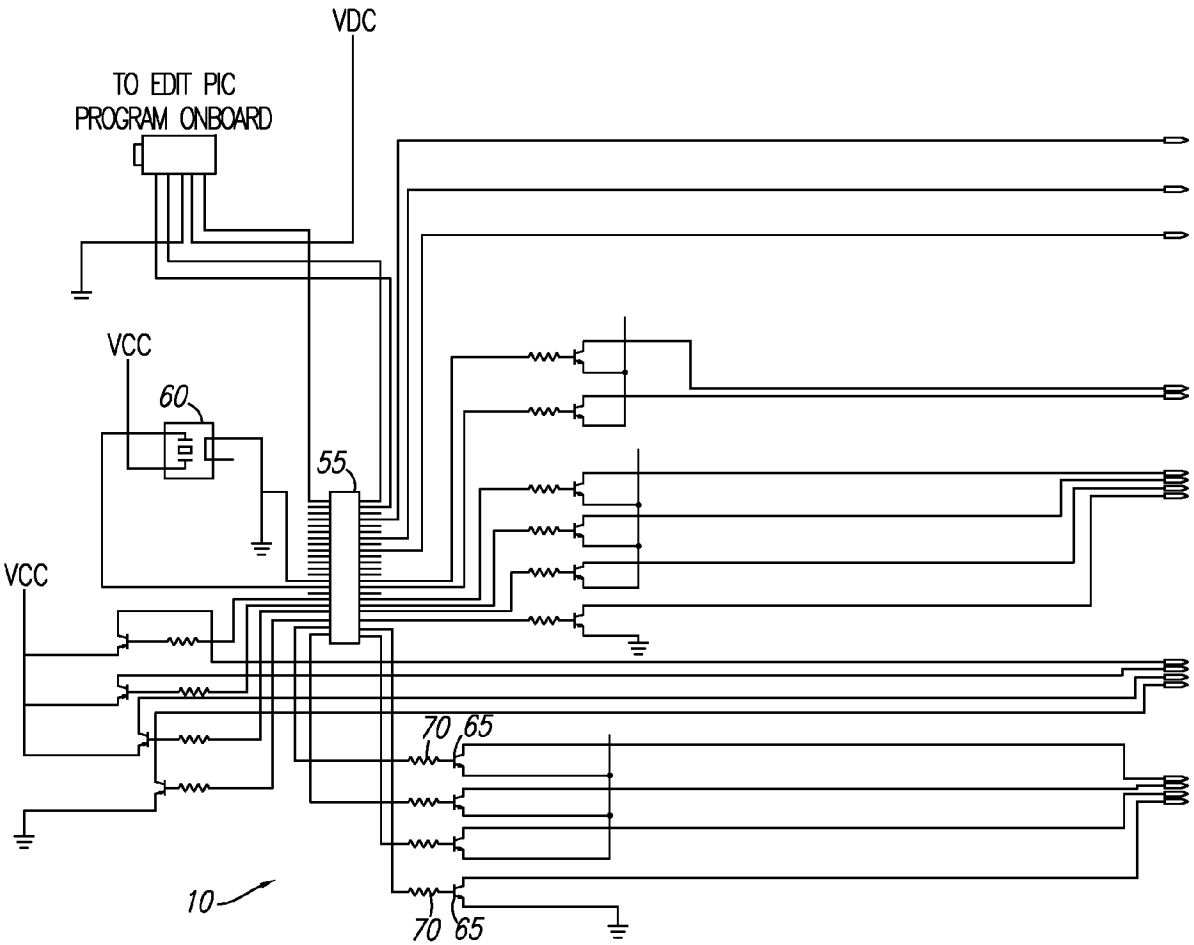
FIG. 2 is an electrical schematic diagram of the components inside of the controller enclosure 30 as used with the user selectable lighting/decoration system 10 according to the preferred embodiment of the present invention.

Referring next to FIG. 2, an electrical schematic diagram of the of the components inside of the controller enclosure 30 as used with the system 10 according to the preferred embodiment of the present invention is depicted. The invention utilizes a PIC microcontroller 55 as the main controlling component of the system 10. It is envisioned that the PIC microcontroller 55 would be a CMOS FLASH-based 8-bit microcontroller in a forty (40) pin package. Such a device would be a PIC16F887 or equal. Features of the PIC microcontroller 55 would include 256 bytes of EEPROM data memory, two (2) Comparators, 14 channels of 10-bit Analog-to-Digital (A/D) converter, a synchronous serial port and an Enhanced Universal Asynchronous Receiver Transmitter (EUSART). It should be noted that other types of PIC microcontroller 55 could be used with equal effectiveness and as such, should not be interpreted as a limiting factor of the present invention. The PIC microcontroller 55 is driven by a quartz oscillator 60. Power to the basic functions are governed by transistors 65 and dropping resistors 70 which drive the outputs of the PIC microcontroller 55. The internal control of the PIC microcontroller 55 is provided by customized C-programming language. This programming language allows the PIC microcontroller 55 to change the color of the RGB light-emitting diodes (LED) 20 (as shown in FIG. 1) up to forty (40) discrete different colors. The color change can be controlled as a gradual transition thus allowing the invention to gradually and easily change from one (1) color to the next. A similar process is used to control the servo motors 40 (as shown in FIG. 1). Inputs to the controller enclosure 30 include various power levels from a power supply as well as any user triggerable inputs with regard to color, rate, motion or the like. It should be noted that these triggerable inputs are not necessary nor required for operation as described.

Figure 3:
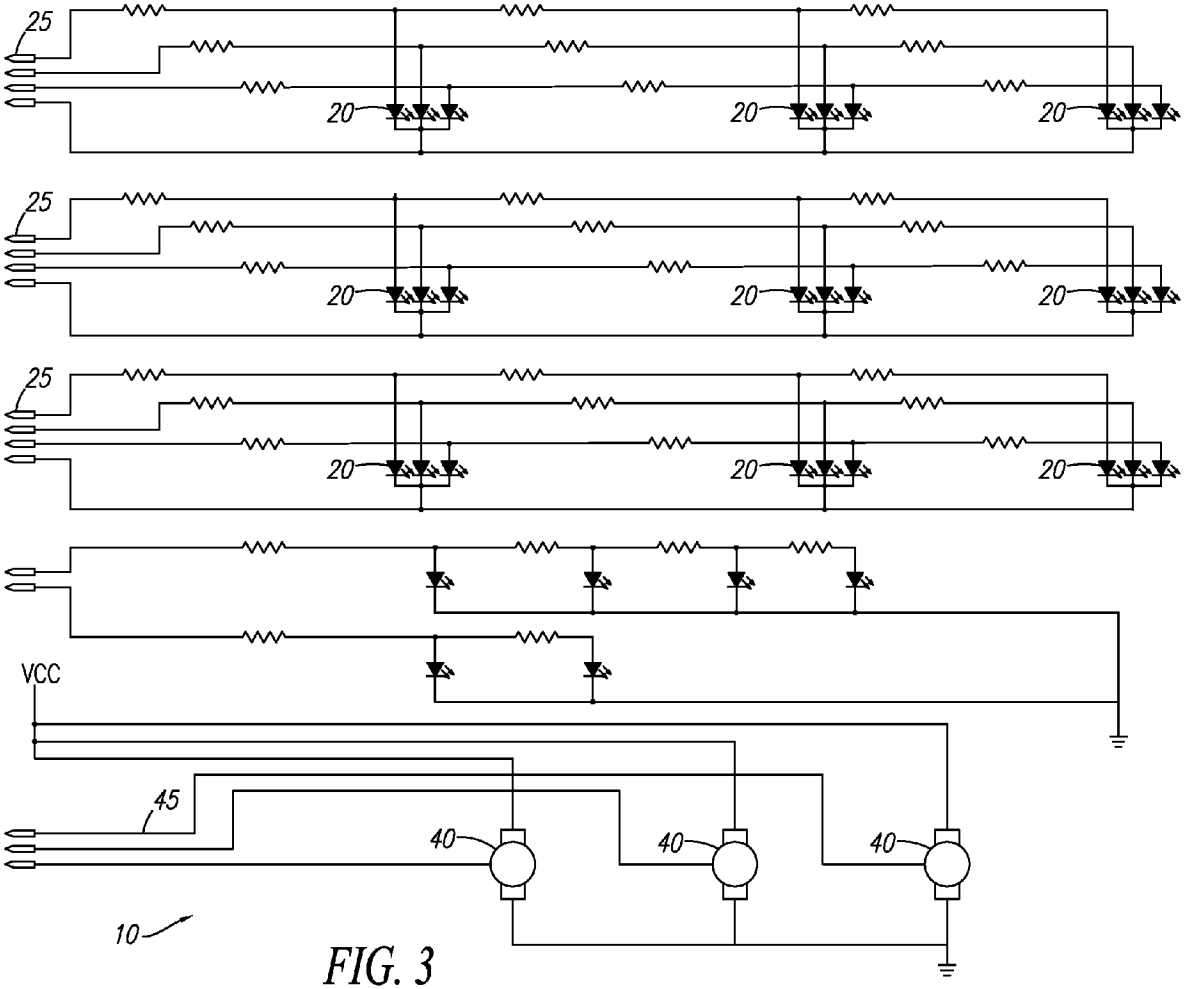
FIG. 3 is an electrical schematic diagram of the components outside of the controller enclosure 30 as used with the user selectable lighting/decoration system 10 according to the preferred embodiment of the present invention.

Referring now to FIG. 3, an electrical schematic diagram of the components outside of the controller enclosure 30 as used with the user selectable lighting/decoration system 10 according to the preferred embodiment of the present invention is shown. The PIC microcontroller 55 (as shown in FIGS. 1 and 2) is connected to a light string cables 25 as shown with four (4) internal conductors per string to the RGB light-emitting diodes (LED) 20. The RGB light-emitting diodes (LED) 20 are envisioned to be of the RL5-RGB-C series or equal with centered wavelengths in the blue, green and red spectrum. Said connection is made with common anode or cathode with such common connection not intended to be a limiting factor of the present invention. Connection to the servo motors 40 are made with a common ground connection as shown. The light string cables 25 and the servo control cables 45 are envisioned to be of a UV-resistant grade and are suitable for use in an outdoor environment in direct sunlight or exposure to rain and snow.

Referring finally to FIGS. 4*a* through 4*d*, a functional flow diagram depicting operation of the system 10 according to the preferred embodiment of the present invention is shown. A begin process block 80 starts with a first functional block 85 which addresses initial preparation of the user selectable lighting/decoration system 10. Such parameters as clock connection, port initialization and other factors would be addressed. Control then passes to a second functional block 90 in which the user or manufacturer would choose color variation as offered by the RGB light-emitting diodes (LED) 20 (as shown in FIG. 1). Control then passes to a third functional block 95 which assigns outputs to the PIC microcontroller 55 (as shown in FIG. 2). In a similar manner, control then passes to a fourth functional block 100 which sets up internal timing circuits of the PIC microcontroller 55 (as shown in FIG. 2). Such timers would allow for the control of color rate change, brightness level and brightness level rate of change, or other user programmable parameters. Such operation is then governed by a fifth functional block 105 in which power is applied to the system 10. Control then passes to a series of sequential loop blocks 110*a*, 110*b*, 110*c*, 110*d*, 110*e*, 110*f*, 110*g* in which random value circuits generate colors, blink rates, motion movement, and the like are generated in a random pattern intended to produce natural and life-like movement of the user selectable lighting/decoration system 10. Upon the desired completion of operation, control is passed to a sixth functional block 115 which ceases operation of the user selectable lighting/decoration system 10 by removal of electrical power thus initiating an end process block 120.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. It is envisioned that the system 10 would be constructed in general accordance with FIG. 1 through FIG. 4*d*. The decorative holiday structure 15 would be assembled in general accordance with FIG. 1 such that a readily recognizable decorative element is built. Various technologies such as wire bending, spot welding, plastic injection molding and the like would be utilized. The use of a specific shape or even the use of a specific holiday, or any holiday decoration is not intended to be a limiting factor of the present invention. Other uses for the user selectable lighting/decoration system 10 include advertising, marketing, novelty, and the like. Next, the RGB light-emitting diodes (LED) 20, preconnected to the light string cables 25 and the controller enclosure 30 are applied to the decorative holiday structure 15. Then, the servo motors 40 are applied to the decorative holiday structure 15 such that they produce physical movement of various portions of the decorative holiday structure 15. Said servo motors 40 are interconnected to the controller enclosure 30 using the servo control cables 45 which are routed on the decorative holiday structure 15 in a discrete manner. A suitable power connection is made to the controller enclosure 30 using the power cord 35.

The internals of the controller enclosure 30 as depicted by FIG. 2 and FIG. 3 are interconnected using a suitable method such as printed circuit board, surface mount components, point to point wiring or the like. Such interconnection means is not intended to be a limiting factor of the present invention. The PIC microcontroller 55 is then loaded with a suitable operating program that produces the desired color effects in the RGB light-emitting diodes (LED) 20 as well as the desired motion in the servo motors 40. Such a program can vary per each different type of use and can be changed as needed or required by simply reprogramming the PIC microcontroller 55 using well known methods.

At this point in time, the system 10 is ready for operation and can be set up in the desired location to produce a festive and eye-catching display to entertain, amuse, or capture the attention of any passer-bys.

The Christmas trees lights with minor software modifications and using ultra bright RGB led bulbs/normal RGB led bulbs, can be used for overhead advertising signs and advertising signs on glass/wall areas of small shops, big shops, or fancy boutiques. Also, the Christmas tree lights with minor software modifications according to customer's preferences, can be wrapped around a small or big display for various goods/goods-on-sale, and also be wrapped around limousines, antique cars, or other cars for special ceremonies or parties such as marriage ceremonies, high school graduation ceremonies, and bachelor parties, and the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A lighting and decoration system comprising:

a decorative structure having a plurality of movable parts and a plurality of motors connected thereto for motioning said movable parts respectively;

a light string cable having a plurality of light-emitting diodes attached thereto for illuminating said movable parts;

a controller communicatively coupled to said light string cable and said motors, respectively; and, a memory including programmable software instructions, when executed by said controller, that executes a control logic algorithm including the steps of:

gradually changing each of said light-emitting diodes from a first color to a second color, respectively, and, gradually moving each of said movable parts from a first position to a second position, respectively.

2. A method of utilizing a lighting and decoration system comprising the steps of:

a. providing a decorative structure having a plurality of movable parts;

b. providing and connecting a plurality of motors to said movable parts for motioning said movable parts respectively;

c. providing and positioning a light string cable on said movable parts;

d. providing and attaching a plurality of light-emitting diodes to said light string cable for illuminating said movable parts respectively;

e. providing and communicatively coupling a controller to said light string cable and said motors, respectively; and, f. providing a memory including programmable software instructions;

g. said controller executing said programmable software instructions and thereby executing a control logic algorithm including the steps of:

i. gradually changing each of said light-emitting diodes from a first color to a second color, respectively, and, ii. gradually moving each of said movable parts from a first position to a second position, respectively.

3. The method of claim 2, wherein step e. comprises the sub-steps of:

setting a plurality of initial parameters including a clock connection and a port initialization;

choosing color variation of said light-emitting diodes; and, assigning outputs to said controller.

4. The method of claim 3, wherein step e. further comprises the sub-steps of:

providing and setting up internal timing circuits of said controller and thereby controlling:

a color rate change of said light-emitting diodes;

a brightness level of said light-emitting diodes; and, a brightness level change rate of said light-emitting diodes.

5. The method of claim 4, wherein step e. further comprises the sub-step of:

providing and connecting random value circuits to said controller, said light string cable and said motors, respectively.

6. The method of claim 5, wherein step g.(i) comprises the sub-step of: generating different colors and different blink rates for each of said light-emitting diodes.

7. The method of claim 6, wherein step g.(ii) comprises the sub-step of:

generating a random movement pattern of said motors and thereby producing natural and life-like movement of said movable parts.

8. A method of utilizing a lighting and decoration system comprising the steps of:

a. providing a decorative structure having a plurality of movable parts;

b. providing and connecting a plurality of motors to said movable parts for motioning said movable parts respectively;

c. providing and positioning a light string cable on said movable parts;

d. providing and attaching a plurality of light-emitting diodes to said light string cable for illuminating said movable parts respectively;

e. providing and communicatively coupling a controller to said light string cable and said motors, respectively; and, f. providing a memory including programmable software instructions;

g. said controller executing said programmable software instructions and thereby executing a control logic algorithm including the steps of:

i. gradually changing each of said light-emitting diodes from a first color to a second color, respectively, and ii. gradually moving each of said movable parts from a first position to a second position, respectively;

wherein said controller independently controls said motors and said light-emitting diodes.

9. The method of claim 8, wherein step e. comprises the sub-steps of:

setting a plurality of initial parameters including a clock connection and a port initialization;

choosing color variation of said light-emitting diodes; and, assigning outputs to said controller.

10. The method of claim 9, wherein step e. further comprises the sub-steps of:

providing and setting up internal timing circuits of said controller and thereby controlling:

a color rate change of said light-emitting diodes;

a brightness level of said light-emitting diodes; and, a brightness level change rate of said light-emitting diodes.

11. The method of claim 10, wherein step e. further comprises the sub-step of:

providing and connecting random value circuits to said controller, said light string cable and said motors, respectively.

12. The method of claim 11, wherein step g.(i) comprises the sub-step of:

generating different colors and different blink rates for each of said light-emitting diodes.

13. The method of claim 12, wherein step g.(ii) comprises the sub-step of:

generating a random movement pattern of said motors and thereby producing natural and life-like movement of said movable parts.

* * * * *